US009345297B2

(12) United States Patent
Brady

(10) Patent No.: US 9,345,297 B2
(45) Date of Patent: May 24, 2016

(54) WALKER STANDING ASSIST DEVICE

(71) Applicant: Robert Brady, Coeur D'Alene, ID (US)

(72) Inventor: Robert Brady, Coeur D'Alene, ID (US)

( * ) Notice: Subject to any disclaimer, the term of this patent is extended or adjusted under 35 U.S.C. 154(b) by 0 days.

(21) Appl. No.: 14/511,776

(22) Filed: Oct. 10, 2014

(65) Prior Publication Data

US 2016/0007702 A1 Jan. 14, 2016

Related U.S. Application Data

(60) Provisional application No. 61/999,964, filed on Jul. 14, 2014.

(51) Int. Cl.
*A45B 9/02* (2006.01)
*A45B 9/00* (2006.01)

(52) U.S. Cl.
CPC ..... *A45B 9/02* (2013.01); *A45B 2009/002* (2013.01); *Y10T 16/4713* (2015.01)

(58) Field of Classification Search
CPC ..... Y10T 16/44; Y10T 16/4713; A45B 1/00; A45B 7/00; A45B 9/02; A45B 2009/002; A61H 3/00; A61H 3/02; A61H 3/04; B62B 1/00
USPC ..... 16/110.1, 426; 135/65, 67, 72, 76
See application file for complete search history.

(56) References Cited

U.S. PATENT DOCUMENTS 1,400,394 A * 12/1921 Warry ..... A61H 3/02 135/65
2,690,188 A * 9/1954 Goddard ..... A61H 3/02 135/72
2,714,255 A * 8/1955 Glazer ..... F02B 77/00 248/206.5
2,855,024 A * 10/1958 Robb ..... A61H 3/00 135/67
3,289,685 A * 12/1966 McCall Parker ..... A61H 3/0244 135/65
5,354,022 A * 10/1994 Coonrod ..... A61G 7/053 248/127
5,445,174 A 8/1995 Cunningham
6,990,990 B2 1/2006 Wilensky et al.
8,714,171 B1 5/2014 Haygood
2003/0137119 A1* 7/2003 Razon ..... A61H 3/008 280/87.021
2003/0226584 A1* 12/2003 Serhan ..... A61H 3/00 135/74
2005/0005959 A1* 1/2005 Diamond ..... A45B 7/00 135/67
2012/0042918 A1* 2/2012 Tessier ..... A45B 1/00 135/67
2014/0261591 A1* 9/2014 Velarde ..... A61H 3/00 135/67

* cited by examiner

*Primary Examiner* — William Miller
(74) *Attorney, Agent, or Firm* — Harpman & Harpman

(57) ABSTRACT

A walker standing assist device for aiding the user of a walker or a wheeled mobility device to stand or arise from a seated position. Most walkers have their hand grips that are too high for normal users to utilize in the standing process. The users hands are directed to an area that locates their position to the walker's support frame members and thus within the center of gravity of the walker. The walker standing assist device generally includes a hand platform disk that is rotatable and pivotable to the users changing hand position in the arising or standing process.

7 Claims, 9 Drawing Sheets

WALKER STANDING ASSIST DEVICE

This application claims the benefit of U.S. Provisional Application No. 61/999,964, filed Jul. 14, 2014.

BACKGROUND OF THE INVENTION

1. Technical Field

The present invention relates generally to walker handles and more specifically it relates to a walker standing assist device for aiding the user of a walker or a wheeled mobility device to stand or arise from a seated position. Most walkers have their hand grips that are too high for normal users to utilize in the standing process. The users hands are directed to an area that locates their position to the walkers support frame members and thus within the center of gravity of the walker.

2. Description of Prior Art

Prior art devices of this type can be seen in U.S. Pat. Nos. 5,445,174, 6,990,990, 8,714,171.

In U.S. Pat. No. 5,445,174 a rising brace for an invalid walker can be seen having a handle secured to and extending by pivot outwardly from the leg of the walker. The hand grip is formed on the upper surface for individual engagement.

U.S. Pat. No. 6,990,990 claims a walker with a pair of support handles that are clamped onto the front support legs of the walker. Each of the handles has a cylindrical grip that pivots outwardly from the leg for adjustable engagement and use by the individual.

Finally, in U.S. Pat. No. 8,714,171 a walker hand rail extension is disclosed that clamps onto the back legs of the walker and extends horizontally and then at right angles downwardly for chair engagement or surface support. The engagement surface affords a pair of oppositely disposed spaced parallel hand surface engagement areas so that an individual sitting can grasp and then stand up using the rails for leverage and support in spaced relation to the walker assembly.

BRIEF SUMMARY OF THE INVENTION

The invention generally relates to a walker handle which includes a hand platform disk that is rotatable and pivotable to the users changing hand position in the arising or standing process.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a walker standing assist device for aiding the user of a walker or a wheeled mobility device to stand or arise from a seated position. Most walkers have their hand grips that are too high for normal users to utilize in the standing process. The users hands are directed to an area that locates their position to the walkers support frame members and thus within the center of gravity of the walker.

Another object is to provide a Walker Standing Assist Device that allows an individual to arise or stand from a seated position without aid from another person or device.

Another object is to provide a Walker Standing Assist Device that is retrofitable and can be attached to a variety of existing walkers to facilitate the individual's ability to change from a sitting to a standing and walking mode.

Another object is to provide a Walker Standing Assist Device that the assist grip can rotate to the individuals preferred position of use depending on their physical needs or requirements.

Another object is to provide a Walker Standing Assist Device that that can be positioned at the preferred height for the individuals physical needs.

Another object is to provide a Walker Standing Assist Device that the hand disk will pivot to the users hand position relative to the standing process. Another object is to provide a Walker Standing Assist Device that the same unit can be used on the right or the left side without alterations simply turning the hand disk from top to bottom.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of this application.

DETAILED DESCRIPTION OF THE INVENTION

Figure 1:
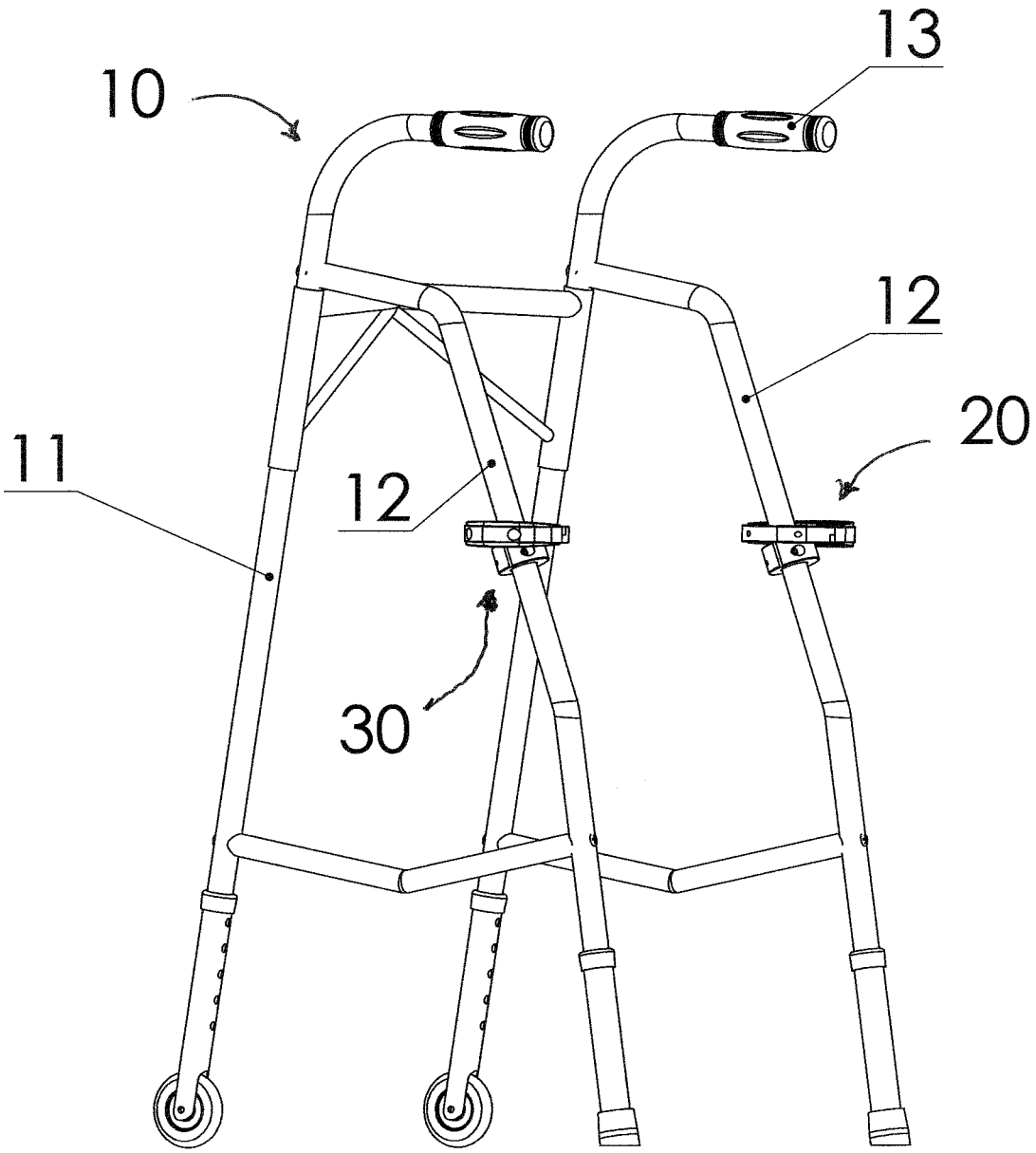
FIG. 1 is a perspective view of a mobility aid commonly known as a step or roller walker with the present invention positioned thereon.
Figure 2:
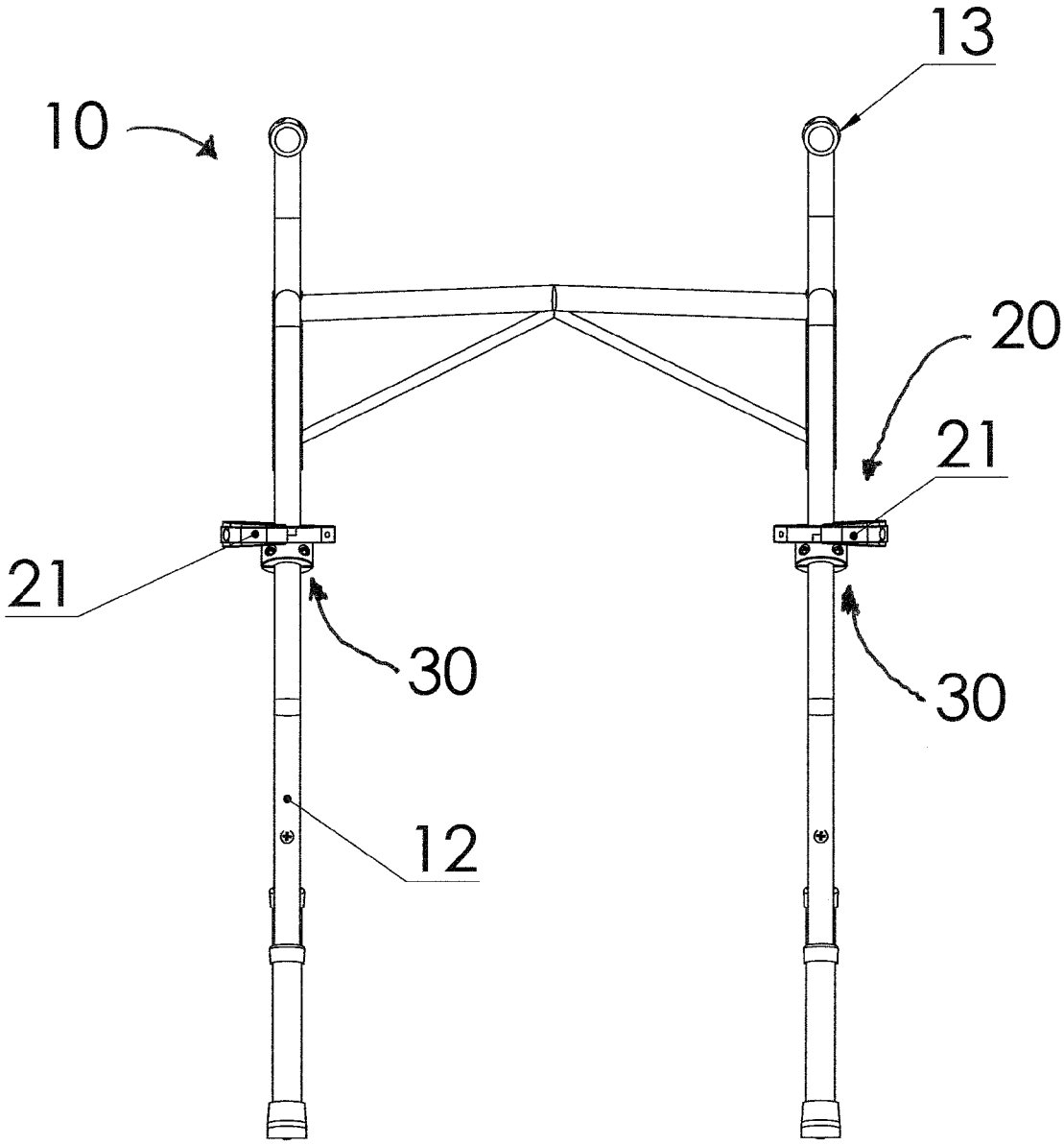
FIG. 2 is a front elevational view thereof.
Figure 3:
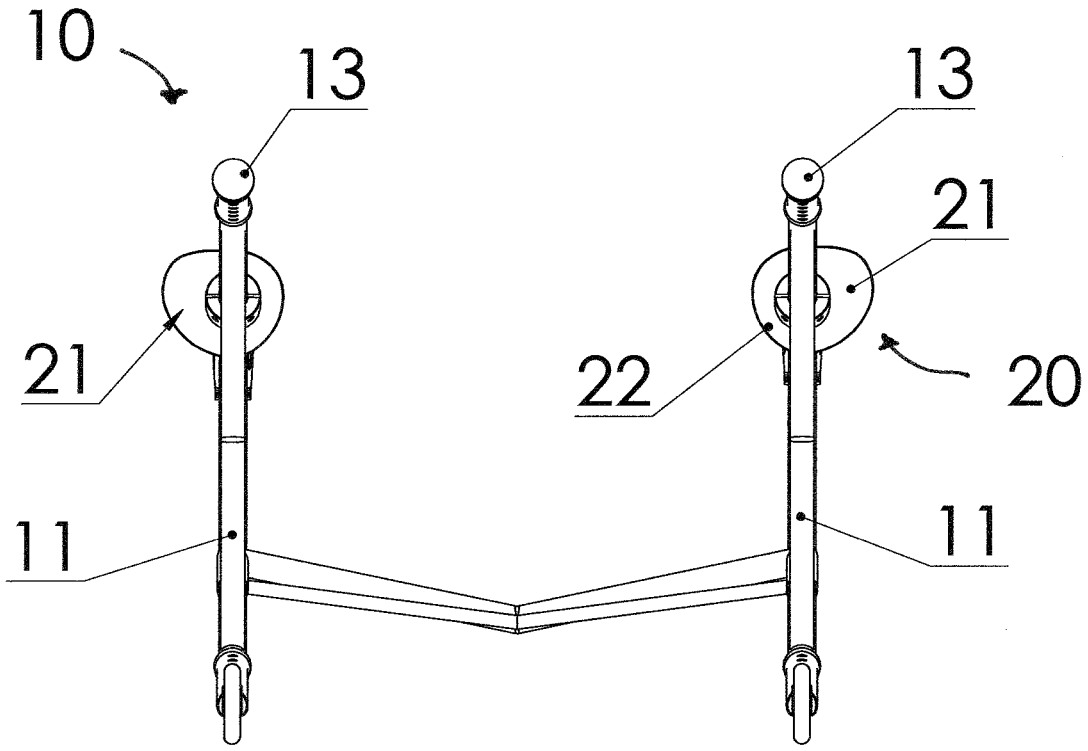
FIG. 3 is a top plan view thereof.
Figure 4:
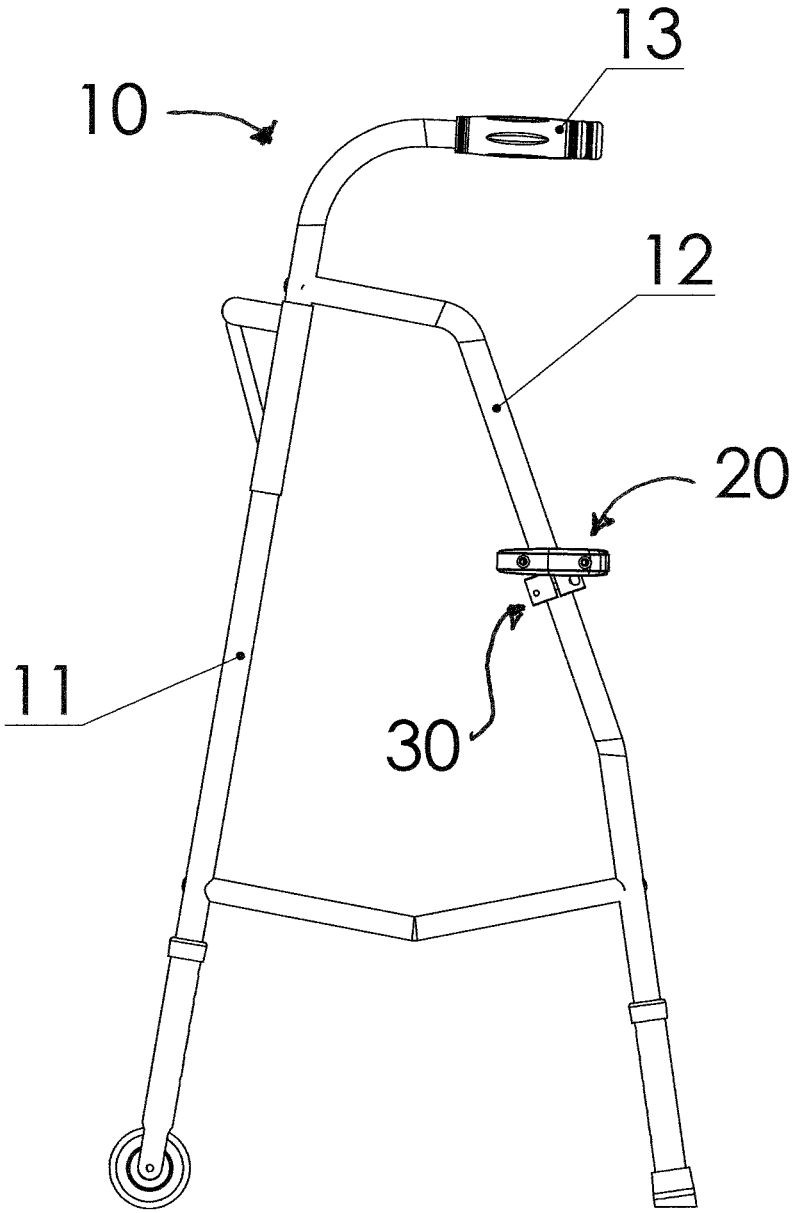
FIG. 4 is a side elevational view thereof.
Figure 5:
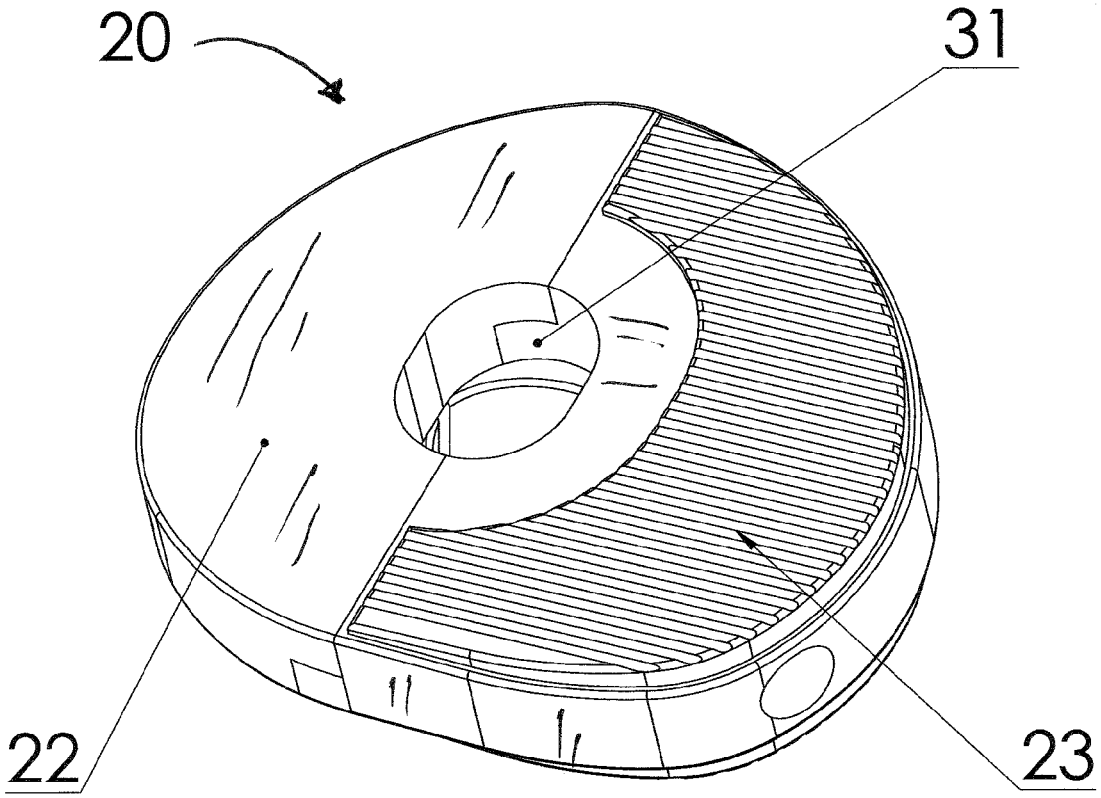
FIG. 5 is an enlarged broken away perspective view of the hand engagement portion of the present invention.

Turning now descriptively to the drawings, in which similar reference characters denote similar elements throughout the several views, the figures illustrate a hand platform disk that is rotatable and pivotable to the users changing hand position in the arising or standing process.

A. Hand Platform Disk

An interlocking, reversible (for left or right hand) position use. Allows rotational support of users changing hand position relative to walker.

Interlocking Hand Support Devise capable of rotational and pivotable movement accommodating the individuals changing hand positional and angular support requirements.

Hand support device is adaptable to different walker frame structures. It is height adjustable of individual preference. It is reversible for left and right walker sides.

It keeps the individuals hand support position closer to the walkers Center of Gravity reducing the chance of inadvertent tipping by the individual in changing from the sitting or prone position to the standing condition.

B. Adjustable Stop Collar

Height adjustable locking collar for varying size individual requirements. Stop collar is fitted to walker frame and supporting the hand platform disk.

Stop collars that are adjustable for the individuals height needs. The top of the stop collar are designed to allow the pivotal support movement throughout the arising/standing.

Designed for different walkers. Allows rotational and pivotable conditions as needed by various individuals.

C. Connections of Main Elements and Sub-Elements of Invention

Adjustable Hand Support Devise has the hand disk support resting atop of the locking stop collar which is height adjustable.

D. Alternative Embodiments of Invention

It is understood that the shape of the Hand disk support can be vary and composition of different materials is expected and understood. Component alterations are projected to assist the individual with carrying or holding items as well.

E. Operation of Preferred Embodiment

This invention pertains to a device that facilitates an individual to transition from a sitting position to a standing position, unaided, for the purpose of use with a walking aid.

Hand Support Disk 20 is to be attached to a walker or walking aid 10 having front and rear legs 11 and 12 respectively and handles 13.

Figure 7:
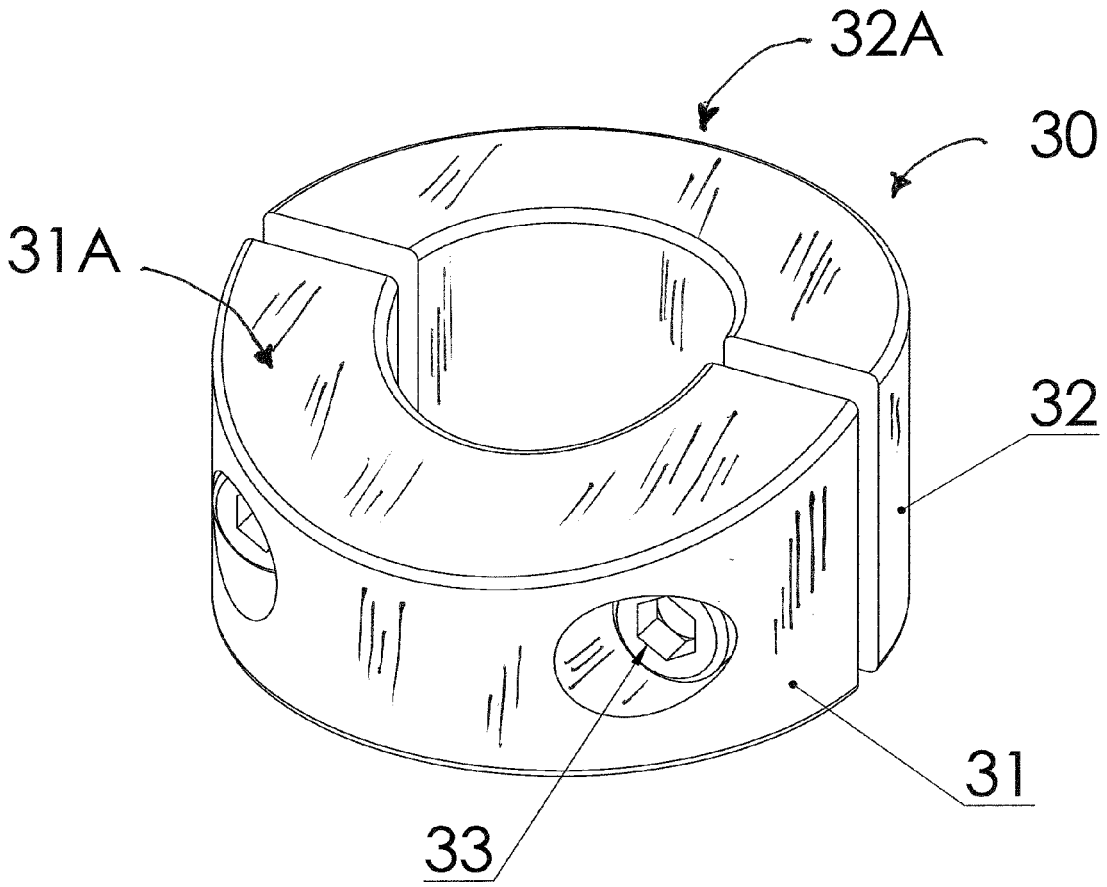
FIG. 7 is an enlarged broken away perspective view of the hand support collar of the invention.
Figure 8:
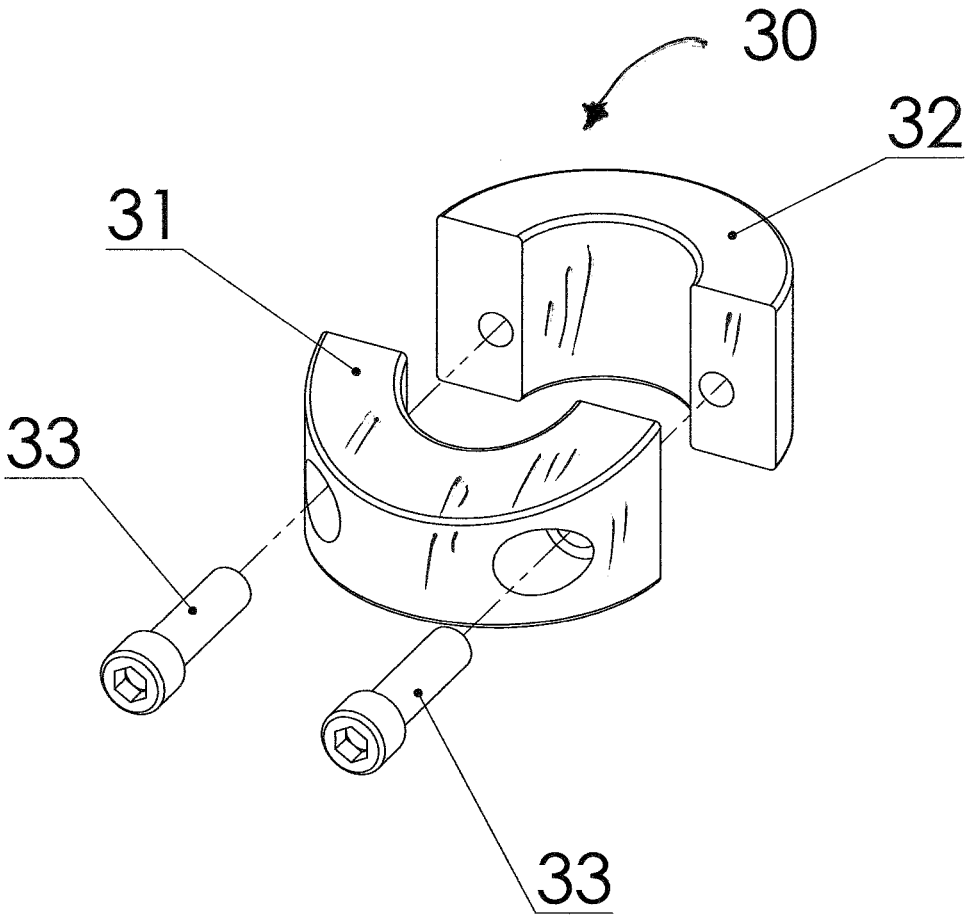
FIG. 8 is an enlarged exploded perspective view thereof.
Figure 9:
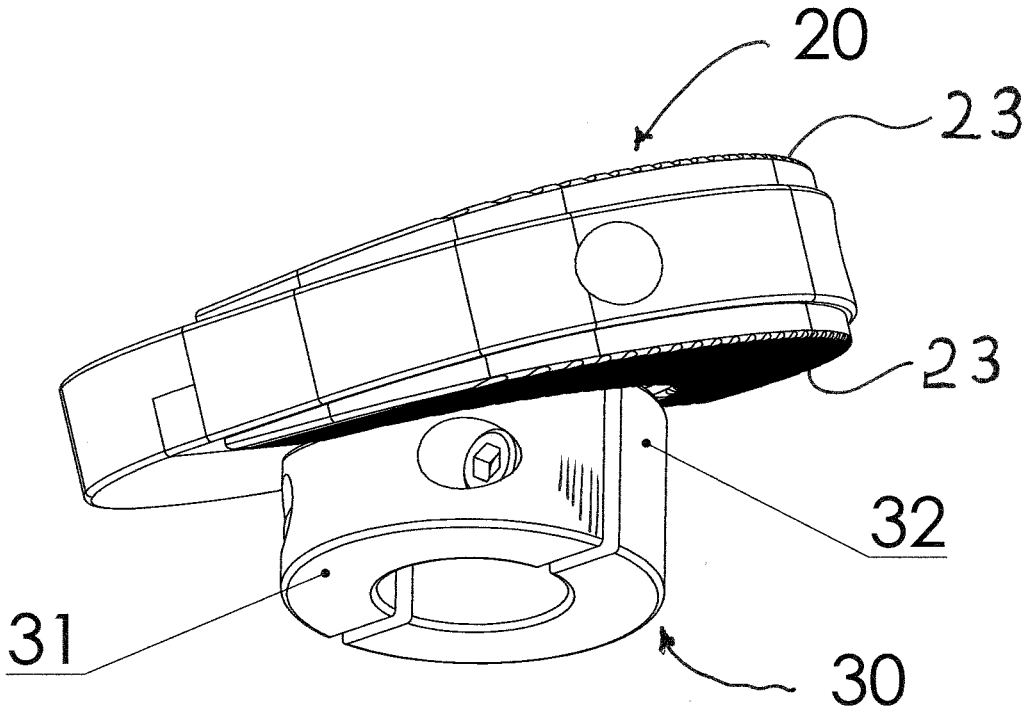
FIG. 9 is an enlarged broken away perspective view of the mobility aid of the invention.

In one embodiment an Adjustable Collar 30 is to be placed on the rear legs 12 of the walker or walking aid. The collar 30 is split having a front collar portion 31 and a back portion. Taking the Back collar portion 32 placing it on the walkers' rear legs 12, then placing the Front collar portion 31 to align with the back collar portion 32 then inserting Locking Screws 33 through the Front facing screw holes to the Back collar portion 32. Adjust to preferred height and tighten. Repeat on the other side adjusting both collars 30 to the same height, as best seen in FIGS. 7 and 8 of the drawings. The front collar portion 31 has an angularly inclined upper surface 31A.

Figure 6:
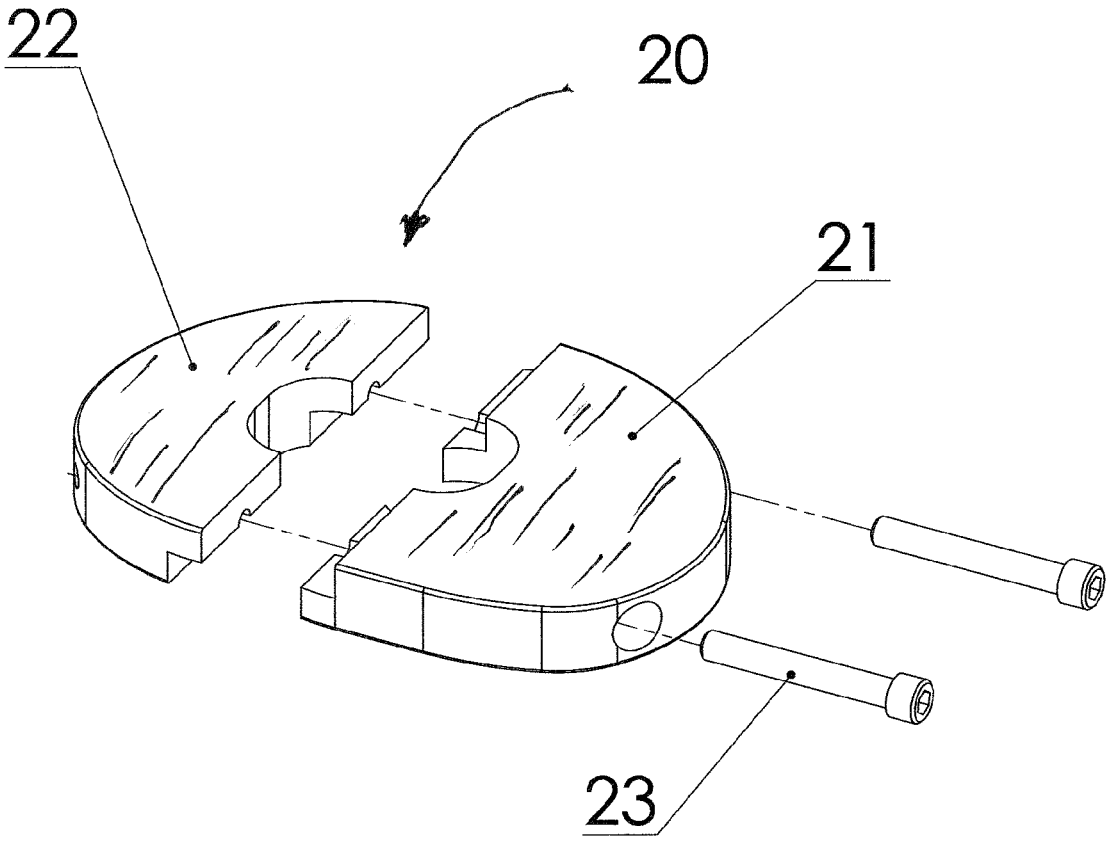
FIG. 6 is an enlarged exploded perspective view thereof.

The hand support disks 20 is then attached to the walkers rear legs 12 above the previously attached collars 30 by tighten disk components 21 and 22 together using screws 23. User can rotate hand support disks 20 to their desired location. The oblong hole 31 in the hand support disks 20 allow the disks 20 to pivot forward in angular inclination on the collar surface 31A or backward in support of the users changing hand position occurring in the standing operation resting on the horizontally planar surface 32A thereof, as seen in FIGS. 1 and 6 of the drawings. The hand support disks 20 have textured resilient pads 23 on the upper and lower surface of disk component 21. The pads 23 provided an improved cushioned grip for the user.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Any headings utilized within the description are for convenience only and have no legal or limiting effect.

Therefore I claim:

1. An adjustable hand engagement support for use on the legs of a walker, said hand engagement support comprising, a split hand support disk having an elongated opening centrally therein, a split stop collar having an angularly disposed upper support disk engagement surface portion, fasteners extending through said split hand support disk, securing said split hand support disk together about the leg of said walker, fasteners extending through said split stop collar for selectively securing said split stop collar to the leg of said walker.

2. The adjustable hand engagement support for use on said walker set forth in claim 1 wherein said split hand support disk has a contoured perimeter edge thereabout defining a flat irregularly shaped assembled body member.

3. The adjustable hand engagement support for use on said walker set forth in claim 1 wherein said angularly disposed upper support disk engagement surface portion is located on one portion of said split hand support disk.

4. The adjustable hand engagement support for said walker set forth in claim 1 wherein said split hand support disk is movable from a first collar surface engagement position on said angularly disposed upper support disk engagement surface portion of said split stop collar to a second collar engagement position on a remaining portion of said split stop collar during user engagement.

5. The adjustable hand engagement support for use on said walker set forth in claim 4 wherein said remaining portion of said split stop collar position is of a flat planar surface at right angles to depending annular sidewalls of said split stop collar.

6. The adjustable hand engagement support for use on said walker set forth in claim 1 wherein said elongated opening in said split hand support disk is of a known diameter greater than that of the annular dimension of said leg of said walker onto which it is so secured.

7. The adjustable hand engagement support for use on said walker set forth in claim 1 wherein said split hand support disk has resilient pads on oppositely disposed engagement surfaces.

* * * * *